United States Patent [19]

Nally

[11] 3,968,967

[45] July 13, 1976

[54] SYMMETRICALLY ARRANGED, HEMISPHERICAL BALL REBOUNDING ELEMENTS

[76] Inventor: Phillip L. Nally, 302 W. Muir, Bardstown, Ky. 40222

[22] Filed: Mar. 28, 1975

[21] Appl. No.: 563,090

[52] U.S. Cl. ..... 273/95 A; 273/102 R; 273/29 A; 273/30

[51] Int. Cl.[2] ..... A63B 71/02

[58] Field of Search ..... 273/29 R, 29 A, 30, 273/95 R, 95 A, 102 R, 102 S, 97 R, 98

[56] References Cited

UNITED STATES PATENTS

| | | | |
|---|---|---|---|
| 1,219,770 | 3/1917 | Potvin | 46/1 |
| 1,928,583 | 9/1933 | Young | 273/97 R |
| 2,482,234 | 9/1949 | Barker | 273/102 R |
| 2,510,883 | 6/1950 | Goldberg | 272/78 |
| 2,769,636 | 11/1956 | Finestone | 273/30 |
| 3,022,072 | 2/1962 | Zinnow | 272/78 |
| 3,088,735 | 5/1963 | Clark | 273/30 |
| 3,516,193 | 6/1970 | Engelman | 46/1 |
| 3,521,885 | 7/1970 | Robinson | 273/95 A |
| 3,599,978 | 8/1971 | Sondergaard | 273/95 R |
| 3,697,068 | 10/1972 | McDougall | 273/29 A |
| 3,795,401 | 3/1974 | Voltz et al. | 273/1.5 A |

*Primary Examiner*—Richard C. Pinkham
*Assistant Examiner*—Marvin Siskind

[57] ABSTRACT

A device for deflecting a resilient ball in an unpredictable manner as an aid in developing speed, coordination, and timing on the part of the person causing the ball to come in forcible contact with the device. The device includes a horizontally disposed base from which project a plurality of hemispheric ball deflecting elements. The distance between such elements is such to cause a ball, when forcibly received thereagainst, to contact at least a portion of one of the elements thereby causing the elastic bouncing of the ball off the elements in an unpredictable manner.

3 Claims, 2 Drawing Figures

SYMMETRICALLY ARRANGED, HEMISPHERICAL BALL REBOUNDING ELEMENTS

BACKGROUND OF THE INVENTION

The present invention relates generally to an apparatus for use by at least one person as a game or as an exercise device to develop reflex or timing skills and, more specifically, to an apparatus that provides for the deflection of a resilient ball, in an unpredictable manner, upon impact with a body member. The body or base member includes a plurality of projections, which are shaped to provide that a ball contacting a portion of a surface of at least one or more of the projections, will be deflected in an unpredictable manner. The projections may be hemispheric or sphericonic in shape and spaced relative to each other so that a ball coming into forcible contact with the body member must contact a portion of a bounce-producing surface of at least one of the projections. As a result, anyone using the apparatus would find it extremely difficult, if not impossible, to develop throwing skills which would enable him to determine with any degree of predictability, the path of deflection the ball might take.

SUMMARY OF THE INVENTION

By this invention, there is provided a game apparatus for deflecting a resilient ball in an unpredictable manner. The game includes a body member, a ball and a tether attached between the upper surface of the body member and the ball. Arranged on the upper surface of the body member are a plurality of ball-deflecting means. The outer surface of the deflecting means are formed to provide bounce-producing surface means. The deflecting means are positioned a distance relative to each other and the size of the ball so that a ball coming into forcible contact with the upper surface of the body member contacts at least a portion of one of the bounce-producing surface means, thereby causing the elastic bouncing of said resilient ball in an unpredictable manner the length of the tether.

DESCRIPTION OF THE PREFERRED EMBODIMENT

Figure 1:
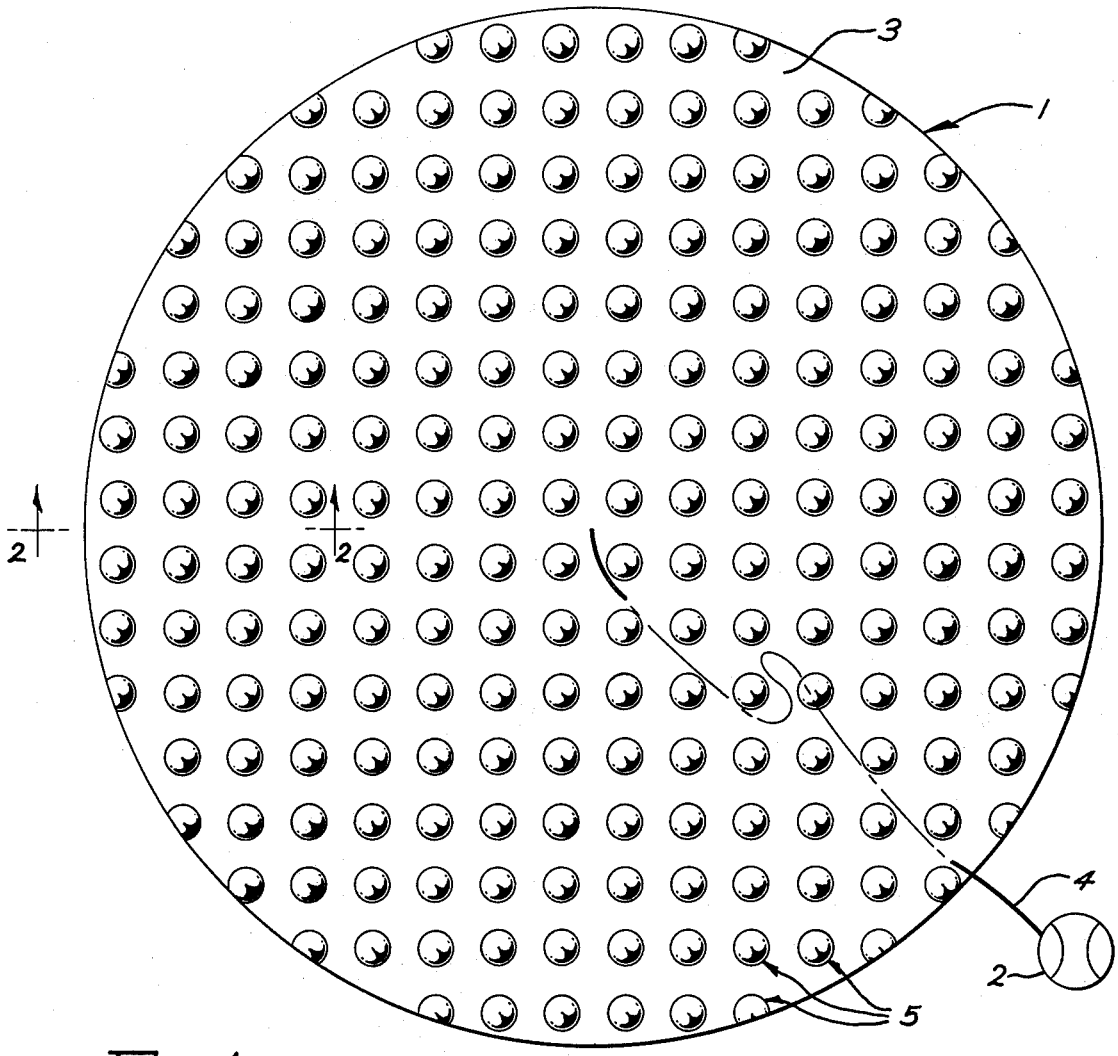
FIG. 1 is a plan view of the game apparatus.

Referring to the drawings, the apparatus comprises a body member 1 and a resilient ball 2. A tether 4 attaches the ball 2 to the upper surface 3 of the body member 1. Arranged on the upper surface 3 are a plurality of individual, spaced-apart ball deflecting means or projections 5. The projections 5 are provided with bounce-producing surfaces 6.

In operation, a person using the apparatus of the present invention may stand adjacent to or in a straddling position and would throw the ball 2 in a substantially downwardly direction against the upper surface 3 of body member 1. The ball 2 coming into forcible contact with the upper surface 3 and, more particularly, with the bounce-producing surface 6 of the projection 5 will bounce in an unpredictable manner. As explained hereinbefore, the apparatus may be used as a game or as a means for developing the reflexes or timing of the person using it.

It should be noted that body member 1 may be formed from any suitable material having a hard surface and that is heavy enough to prevent displacement or objectional movement thereof when it is being used in the above-described manner. To this end, lightweight materials may be used it they were appropriately weighted.

The resilient ball 2 may be an ordinary tennis ball and the tether 4 can be of any suitable length that allows free travel of the ball 2 as it leaves body member 1, while at the same time permitting convenient retrieval of the ball 2 in the event it gets by the user.

While the ball-deflecting projections 5 as shown in the present embodiment are hemispheric, it should be noted, however, that projections having other configurations may be employed, such as conical or sphericonical. The details of constructions, dimensions and parameters described herein, however, are related to projections having hemispheric configurations.

The projections 5 may be located or arranged as shown in FIG. 1 so as to line up in rows perpendicular to and diagonal to each other. While the particular arrangement or layout of the projections 5 is a matter of choice, it should be noted that the base diameter of the projections 5 and their spacing relative to each other and the diameter of the ball 2 used is critical. For example, the spacing of projections 5, the bounce characteristics of the ball 2, the bounce-producing quality of the surfaces 6, together with the speed at which the ball 2 is thrown, are all determining factors regarding the angle of deflection and the speed at which the ball 2 leaves the body member 1. To this end, the person using the apparatus can determine the benefits that he may derive from the apparatus by the speed he throws the ball at the body member 1.

The spacing of the projections 5, as shown in the present embodiment, are such that a ball 2 coming into forcible contact with surface 3 must contact a portion of a bounce-producing surface 6 of at least one of the projections 5. In other words, the projections 5 are so spaced that the ball 2 cannot come in contact with only the relatively flat surface 3 and bounce straight up in a predictable path, but must in fact come in contact with a surface 6 which will produce the unpredictable bounce.

In the present embodiment using the following parameters, a person causing the ball 2 to forcibly contact one of the bounce-producing surfaces 6 and possessing substantially normal reflexes should be capable of catching the ball on the fly between 70 and 80% of the time before the ball extends the tether to its full length.

1. Diameter of base member — 36 inches ± 6 inches
2. Base diameter of projections 5 — 1.25 inches - 1.50 inches
3. Center of projections 5 — 1.50 inches – 2.00 inches
4. Diameter of ball 2 — 2 inches ± 0.25 inches.

Figure 2:
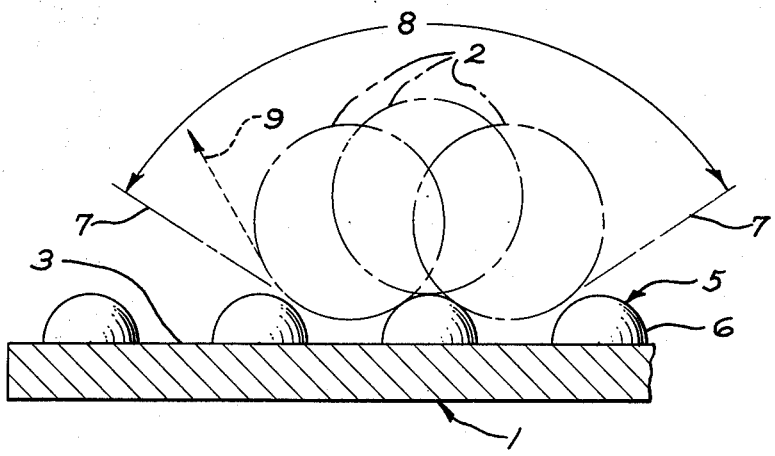
FIG. 2 is a fragmentary side elevational view taken along lines 2—2 of FIG. 1.

Referring now to FIG. 2, the angle designated by the reference numeral 8 represents the full angle or range of deflection relative to each of the ball-deflecting projections 5 that a ball forcibly engaging a surface 6 might take. The lines 7—7′ indicate the extreme lowest angle of deflection a ball could take without contacting an adjacent projection 5.

In the event a ball contacted a surface 6 that would cause an angle of deflection lower or more acute than that represented by line 7—7′, it would contact the bounce-producing surface 6 of an adjacent projection 5 and, as a result, would change direction to a more vertical angle as indicated by line 9.

While lower angles of deflections are possible, it should be noted that they would cause the hereinbeforementioned 70 – 80% chance of catching the ball to be lowered. The apparatus of the present invention could, however, be designed for use by persons possessing greater than normal reflexes and timing, in which case lower angles of deflections would offer greater challenges. One way to achieve these lower deflection angles would be to increase the spacing of the projections 5 so that the ball 2 would pass over an adjacent one at a lower angle and, as a result, will widen the range angle 8.

In summary, a ball 2 forcibly engaging a bounce-producing surface 6 can deflect therefrom at any angle above the horizontal between 7—7'. It should also be noted that the angle 8 is generated 360° to form an imaginary inverted cone within which are all of the possible deflection angles a ball may take relative to each of the projections 5. As a result, it would be impossible to predict the manner in which a ball will bounce and therefrom present a challenge for the user in trying to catch a ball on the fly.

While there has been shown and described a specific embodiment of the invention, it will be understood that it is not limited thereto and it is intended by the appended claims to cover all such modifications as fall within the true spirit and scope of the invention.

I claim:

1. A game apparatus for deflecting a resilient ball in an unpredictable manner comprising:

a body member having a horizontally disposed base and a flat upper surface;

a tether member attached between said upper surface of said body member and said ball to provide limited movement of said ball relative to said body member;

a plurality of hemispheric ball-deflecting means projecting from said flat upper surface and arranged in an ordered pattern, the outer surface of each of said deflecting means providing bounce-producing surface means;

said deflecting means, each being symetrical about a vertical axis and being positioned a distance relative to each other sufficient to cause the surface of said ball when forcibly received against said upper surface to contact at least a portion of one of said bounce-producing surfaces rather than contacting only a flat portion of said upper surface, thereby causing the elastic bouncing of said resilient ball off said bounce-producing surface in an unpredictable manner the length of the tether.

2. The game apparatus of claim 1 wherein said body member is circular and has a diameter of between 30 inches – 42 inches and said hemispheric ball-deflecting means are spaced on 1.5 inches – 2 inches centers.

3. The game apparatus of claim 2 wherein said ball has a diameter between 2 inches and 2.25 inches and said hemispheric ball-deflecting means have a diameter of between 1.25 inches to 1.5 inches.

* * * * *